US008922477B2

(12) United States Patent
Uesaka et al.

(10) Patent No.: US 8,922,477 B2
(45) Date of Patent: Dec. 30, 2014

(54) DRIVE APPARATUS FOR DISPLAY MEDIUM, COMPUTER READABLE MEDIUM STORING DRIVE PROGRAM, DISPLAY APPARATUS, AND DRIVE METHOD FOR DISPLAY MEDIUM

(75) Inventors: Tomozumi Uesaka, Kanagawa (JP); Ryota Mizutani, Kanagawa (JP); Yasufumi Suwabe, Kanagawa (JP); Yoshinori Machida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 13/399,105

(22) Filed: Feb. 17, 2012

(65) Prior Publication Data

US 2013/0050281 A1 Feb. 28, 2013

(30) Foreign Application Priority Data

Aug. 23, 2011 (JP) ..... 2011-181717

(51) Int. Cl.
*G09G 3/34* (2006.01)
*G09G 5/10* (2006.01)

(52) U.S. Cl.
CPC ..... *G09G 5/10* (2013.01)
USPC ..... 345/107

(58) Field of Classification Search
CPC ..... G09G 3/344–3/3453; G09G 2310/068
USPC ..... 345/87–104, 204–215, 690–699
See application file for complete search history.

(56) References Cited

U.S. PATENT DOCUMENTS 7,656,576 B2 * 2/2010 Suwabe et al. ..... 359/296
8,405,599 B2 * 3/2013 Machida et al. ..... 345/107
2007/0236448 A1 * 10/2007 Machida et al. ..... 345/107
2007/0262949 A1 * 11/2007 Zhou et al. ..... 345/107
2008/0036731 A1 * 2/2008 Shigehiro et al. ..... 345/107
2008/0112040 A1 * 5/2008 Suwabe et al. ..... 359/296
2008/0117165 A1 * 5/2008 Machida et al. ..... 345/107
2008/0303778 A1 * 12/2008 Machida et al. ..... 345/107
2009/0153943 A1 * 6/2009 Machida et al. ..... 359/296
2010/0127966 A1 5/2010 Miyamoto
2011/0032276 A1 * 2/2011 Chen et al. ..... 345/690
2011/0134506 A1 * 6/2011 Hiji et al. ..... 359/296
2011/0175939 A1 * 7/2011 Moriyama et al. ..... 345/690
2011/0298835 A1 * 12/2011 Machida et al. ..... 345/690
2012/0139966 A1 * 6/2012 Mizutani et al. ..... 345/690
2012/0200610 A1 * 8/2012 Sakamoto et al. ..... 345/690

FOREIGN PATENT DOCUMENTS

JP 2010-128202 A 6/2010

* cited by examiner

*Primary Examiner* — Patrick F Marinelli
(74) *Attorney, Agent, or Firm* — Sughrue Mion, PLLC

(57) ABSTRACT

A drive apparatus that drives a display medium that includes display and rear substrates, a disperse medium, and a particle group, includes a voltage application unit that applies first and second voltages to the display medium, in which, when a color of the particle group is displayed, the voltage application unit applies the first voltage higher than or equal to a threshold voltage necessary for the particle group to be detached from the display substrate or the rear substrate to a pixel where the particle group is moved between the substrates and applies the second voltage having a same polarity as the first voltage and is lower than the threshold voltage to the pixel where the particle group is moved between the substrates and to a pixel adjacent to the pixel where the particle group is moved between the substrates and the particle group of which is not moved.

11 Claims, 10 Drawing Sheets

-V1

+V1

DRIVE APPARATUS FOR DISPLAY MEDIUM, COMPUTER READABLE MEDIUM STORING DRIVE PROGRAM, DISPLAY APPARATUS, AND DRIVE METHOD FOR DISPLAY MEDIUM

CROSS-REFERENCE TO RELATED APPLICATIONS

This application is based on and claims priority under 35 USC 119 from Japanese Patent Application No. 2011-181717 filed Aug. 23, 2011.

BACKGROUND

Technical Field

The present invention relates to a drive apparatus for a display medium, a computer readable medium storing a drive program, a display apparatus, and a drive method for a display medium.

SUMMARY

According to an aspect of the invention, there is provided a drive apparatus that drives a display medium that includes a display substrate having a light transparency, a rear substrate facing the display substrate with a gap between the display substrate and the rear substrate, a disperse medium filled in between the display substrate and the rear substrate, and a particle group that includes a plurality of particles which is dispersed in the disperse medium and has a color different from a color of the disperse medium and moves the plurality of particles between the substrates in accordance with an electric field, the drive apparatus including a voltage application unit that applies a first voltage and a second voltage to the display medium, in which, in a case where the color of the particle group is displayed, the voltage application unit applies the first voltage higher than or equal to a threshold voltage necessary for the particle group to be detached from the display substrate or the rear substrate to a pixel where the particle group is moved between the substrates and thereafter applies the second voltage that has a same polarity as the first voltage and is lower than the threshold voltage to the pixel where the particle group is moved between the substrates and to a pixel which is adjacent to the pixel where the particle group is moved between the substrates and the particle group of which is not moved.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings. Components operating same actions and functions are assigned the same reference symbols throughout the drawings, and a redundant description may be omitted in some cases. Also, to simplify the description, the exemplary embodiments of the present invention will be described by using a drawing in which attention is appropriately paid on one cell.

Also, a particle in cyan color is described as cyan particle C, a particle in magenta color is described as magenta particle M, and the respective particles and a particle group thereof are denoted by the same symbols (reference symbols).

Figure 1A:
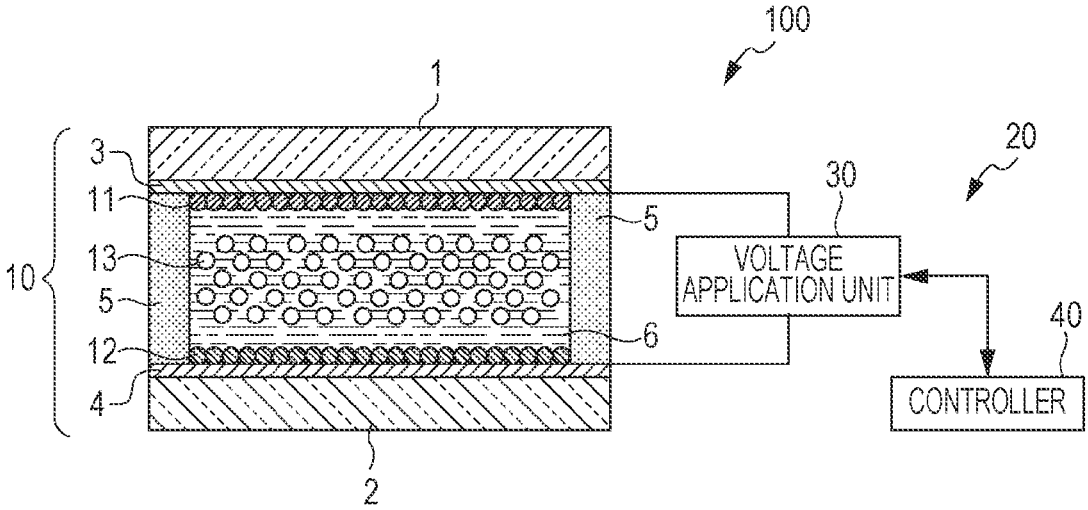
FIG. 1A and FIG. 1B are schematic diagrams illustrating a display apparatus.

FIG. 1A schematically illustrates a display apparatus according to a first exemplary embodiment. A display apparatus 100 is provided with a display medium 10 and a drive apparatus 20 that drives the display medium 10. The drive apparatus 20 includes a voltage application unit 30 that applies a voltage between a display-side electrode 3 and a rear-side electrode 4 of the display medium 10 and a controller 40 that controls the voltage application unit 30 in accordance with image information of an image to be displayed on the display medium 10. The display-side electrode 3 and the rear-side electrode 4 may be external electrodes instead of being provided to the display substrate 1 and the rear substrate 2.

In the display medium 10, the display substrate 1 that is set as an image display surface and has a light transparency and the rear substrate 2 that is set as a non-image display surface are arranged while facing each other with a gap therebetween.

Spacing members 5 that keep a certain gap between the substrates 1 and 2 and divide the space between the substrates into plural cells are provided.

The above-mentioned cell represents a region surrounded by the rear substrate 2 on which the rear-side electrode 4 is provided, the display substrate 1 on which the display-side electrode 3 is provided, and the spacing members 5. The cell is filled with, for example, a disperse medium 6 composed of an insulating fluid and a first particle group 11, a second particle group 12, and a white color particle group 13 dispersed in the disperse medium 6.

Colors and charge polarities of the first particle group 11 and the second particle group 12 are different from each other and the first particle group 11 and the second particle group 12 have characteristics that the first particle group 11 and the second particle group 12 independently migrate when a voltage higher than or equal to a certain threshold voltage is applied between the pair of electrodes 3 and 4. On the other hand, the white color particle group 13 is a particle group that has a charge amount lower than the first particle group 11 and the second particle group 12 and does not move to either electrode side even when a voltage at which the first particle group 11 and the second particle group 12 move to one of the electrode sides is applied between the electrodes.

According to the present exemplary embodiment, a case will be described in which the first particle group 11 is a group of negatively charged electrophoresis particles having a color of magenta (magenta particles M) and the second particle group 12 is a group of positively charged electrophoresis particles having a color of cyan (cyan particles C), but the exemplary embodiment is not limited to this. The colors and charge polarities of the respective particles may be appropriately set. Also, a value of a voltage to be applied in the following description is an example and is not limited to this. The value of the voltage may be appropriately set in accordance with the charge polarities and responsivity of the respective particles, a distance between the electrodes, and the like.

White color that is different from the color of the migrating particles may be displayed by mixing the disperse medium with coloring agent.

The drive apparatus 20 (the voltage application unit 30 and the controller 40) causes the particle groups 11 and 12 to migrate by applying a voltage in accordance with a color to be displayed between the display-side electrode 3 and the rear-side electrode 4 of the display medium 10 and to be attracted to one of the display substrate 1 and the rear substrate 2 in accordance with the respective charge polarities.

The voltage application unit 30 is electrically connected to both the display-side electrode 3 and the rear-side electrode 4. Also, the voltage application unit 30 is connected to the controller 40 so as to transmit and receive signals.

Figure 1B:
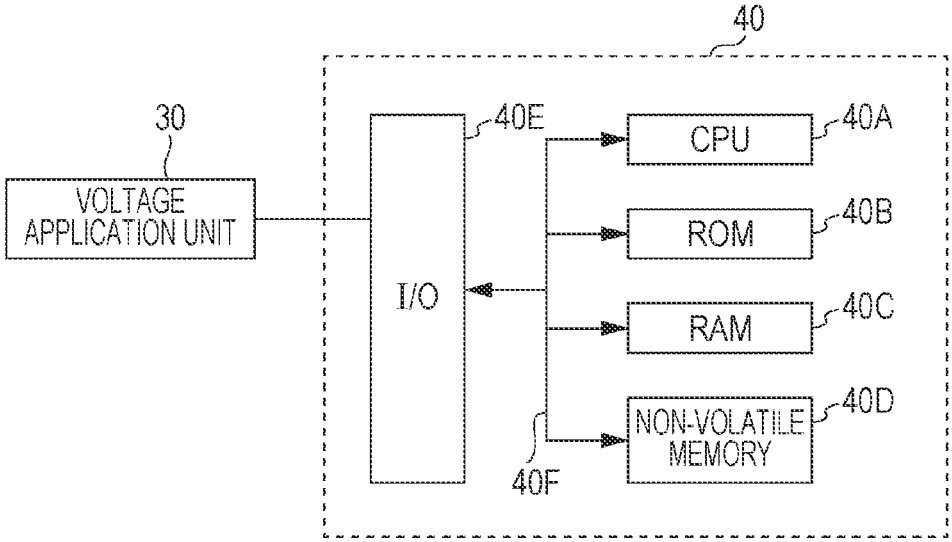

As illustrated in FIG. 1B, for example, the controller 40 is a computer 40. The computer 40 includes a central processing unit (CPU) 40A, a read only memory (ROM) 40B, a random access memory (RAM) 40C, a non-volatile memory 40D, an input output interface (I/O) 40E, and a bus 40F connecting those units, and the voltage application unit 30 is connected to the I/O 40E. In this case, a program for causing the computer 40 to execute a process of instructing the voltage application unit 30 to apply a voltage necessary for a display of respective colors that will be described below is written, for example, in the non-volatile memory 40D, and the CPU 40A reads this program for execution. The program may be provided by a recording medium such as a CD-ROM.

The voltage application unit 30 is a voltage application apparatus configured to apply a voltage to the display-side electrode 3 and the rear-side electrode 4 and apply the voltage in accordance with a control of the controller 40 to the display-side electrode 3 and the rear-side electrode 4.

According to the present exemplary embodiment, a case will be described as an example in which the display-side electrode 3 is grounded and the voltage is applied to the rear-side electrode 4.

Figure 2:
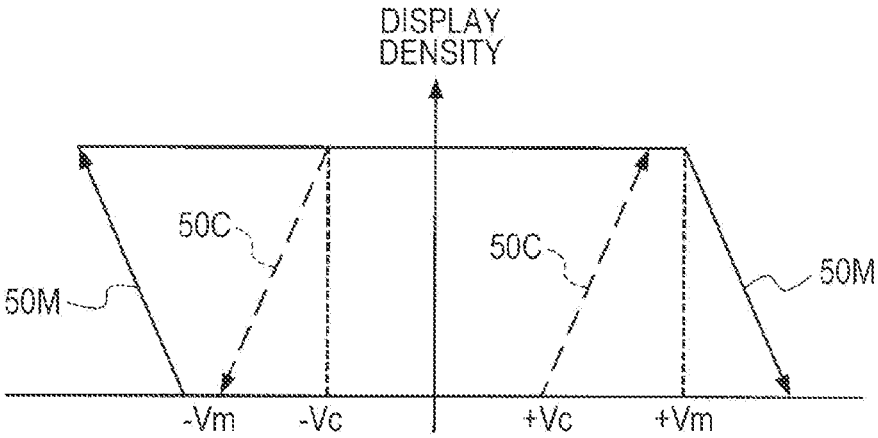
FIG. 2 illustrates voltage application characteristics of respective migrating particles.

FIG. 2 illustrates characteristics of application voltages necessary for the cyan particles C and the magenta particles M to move to the display substrate 1 side and the rear substrate 2 side in the display apparatus 100 according to the present exemplary embodiment. In FIG. 2, an application voltage characteristic of the cyan particles C is represented as characteristic 50C and application voltage characteristic of the magenta particles M is represented as characteristic 50M.

FIG. 2 also illustrates a relationship between pulse voltages applied to the rear-side electrode 4 while the display-side electrode 3 is grounded (0 V) and display densities by the respective particle groups.

As illustrated in FIG. 2, a movement start voltage (threshold voltage) at which the magenta particles M on the rear substrate 2 side start to move to the display substrate 1 side is −Vm, and a movement start voltage (threshold voltage) at which the magenta particles M on the display substrate 1 side start to move to the rear substrate 2 side is +Vm. Therefore, the magenta particles M on the rear substrate 2 side move to the display substrate 1 side by applying a voltage lower than or equal to −Vm, and the magenta particles M on the display substrate 1 side move to the rear substrate 2 side by applying a voltage higher than or equal to +Vm.

At the same voltage value of the voltage to be applied, for example, the particle amount of magenta particles M on the rear substrate 2 side moving to the display substrate 1 side is controlled by changing a pulse width (application time) thereof (pulse width modulation). For example, in a case where the voltage value of the voltage to be applied is set as a certain voltage lower than −Vm, as a pulse width thereof becomes longer, the particle amount of the magenta particles M moving to the display substrate 1 side becomes higher. According to this configuration, a gradation display of the magenta particles M is controlled. The same applies to a particle amount in a case where the magenta particles M on the display substrate 1 side move to the rear substrate 2 side.

Also, a movement start voltage (threshold voltage) at which the cyan particles C on the rear substrate 2 side start to move to the display substrate 1 side is +Vc, and a movement start voltage at which the cyan particles C on the display substrate 1 side start to move to the rear substrate 2 side is −Vc. Therefore, the cyan particles C on the rear substrate 2 side move to the display substrate 1 side by applying a voltage higher than or equal to +Vc, and the cyan particles C on the display substrate 1 side move to the rear substrate 2 side by applying a voltage lower than or equal to −Vc.

Similarly as in the above-mentioned case of the magenta particles M, for example, at the same voltage value of the voltage to be applied, the particle amount of the cyan particles C on the rear substrate 2 side moving to the display substrate 1 side or the particle amount of the cyan particles C on the display substrate 1 side moving to the rear substrate 2 side is controlled by changing a pulse width thereof.

Alternatively, the pulse width of the voltage to be applied is not changed, and the moving particle amount may be controlled by changing the voltage value so that the gradation display may be controlled (voltage modulation). For example, in a case where the particle amount of the magenta particles M on the rear substrate 2 side moving to the display substrate 1 side is controlled, the pulse width of the voltage to be applied is not changed and the voltage value is set to an arbitrary value lower than or equal to −Vm, thereby moving the magenta particles M to the display substrate 1 side, the particle amount of which corresponds to the voltage value.

In the following explanation, as an example, a case will be described in which the particle amount of the moving particles is controlled by the voltage modulation.

Next, displays of the respective colors will be described. The display-side electrode 3 is grounded (0 V). The magenta particles M and the cyan particles C between the substrates are equal in number.

FIGS. 3A to 6C schematically illustrate examples of behaviors of the magenta particles M and the cyan particles C in accordance with the voltage application in the display medium according to the first exemplary embodiment. In FIGS. 3A to 6C, the white color particles 13, the disperse medium 6, the spacing member 5, and the like are omitted.

Figure 3A:
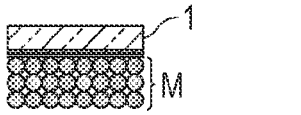
FIGS. 3A to 3C are schematic diagrams illustrating behaviors of the migrating particles in accordance with voltage applications.
Figure 3A:
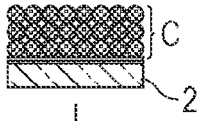

As illustrated in FIG. 3A, when the rear-side electrode 4 is applied with a voltage of a voltage value −V1 that is a voltage value lower than −Vm and is necessary for all the magenta particles M on the rear substrate 2 side to attach to the display substrate 1 side at a certain pulse width, all the negatively charged magenta particles M migrate to the display substrate 1 side and the positively charged cyan particles C migrate to the rear substrate 2 side to attach to the entire surfaces of the respective substrates. Accordingly, magenta color is displayed.

Figure 3B:
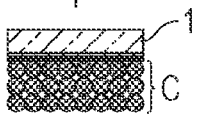
Figure 3B:
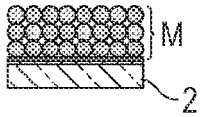

As illustrated in FIG. 3B from the state of FIG. 3A (magenta display), when the rear-side electrode 4 is applied with a voltage of a voltage value +V1 that is a voltage value higher than +Vm and is necessary for all the magenta particles M on the display substrate 1 side to attach to the rear substrate 2 side and also all the cyan particles C on the rear substrate 2 side to attach to the display substrate 1 side at a certain pulse width, the positively charged cyan particles C migrate to the display substrate 1 side and the negatively charged magenta particles M migrate to the rear substrate 2 side to attach to the entire surfaces of the respective substrates. Accordingly, cyan color is displayed.

Figure 3C:
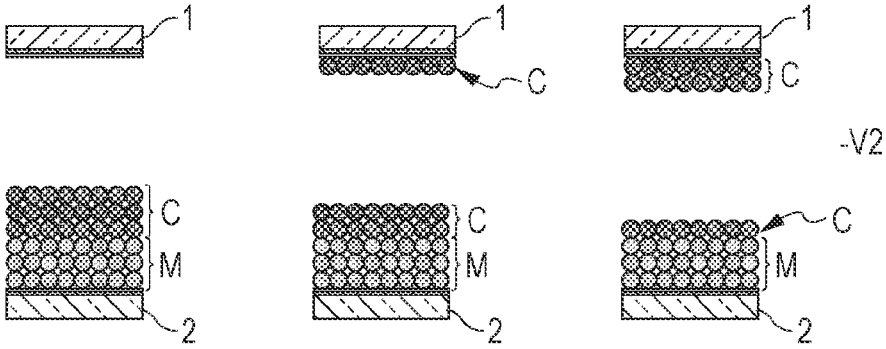

As illustrated in FIG. 3C from the state of FIG. 3B (cyan display), when the rear-side electrode 4 is applied with a voltage of a voltage value −V2 that is a voltage value lower than −Vc and higher than −Vm and is necessary for the particle amount of the cyan particles C among the cyan particles C on the display substrate 1 side, in accordance with the gradation that should be displayed, to remain on the display substrate 1 side and the other cyan particles C (the cyan particles C that should be detached from the display substrate 1) to move to the rear substrate 2 side at a certain pulse width, the particle amount of the cyan particles C that should be detached in accordance with the gradation migrates to the rear substrate 2 side to attach to the rear substrate 2 side. FIG. 3C illustrates a case in which the amount of the cyan particles C moving to the rear substrate 2 side is decreased in the order illustrated at the left, at the center, and at the right. That is, the pulse width of the applied voltage becomes shortened in the order of the left side state, the center state, and the right side state of FIG. 3C.

Figure 4A:
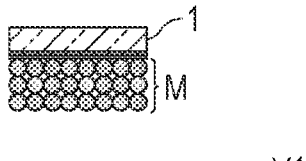
FIGS. 4A to 4C are schematic diagrams illustrating behaviors of the migrating particles in accordance with voltage applications.
Figure 4B:
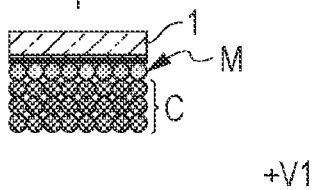

As illustrated in FIG. 4B from the state of FIG. 4A (that is the same as FIG. 3A) (magenta display), when the rear-side electrode 4 is applied with a voltage of a voltage value +V1 that is a voltage value higher than +Vm and is necessary for the particle amount of the magenta particles M among the magenta particles M on the display substrate 1 side, in accordance with the gradation that should be displayed, to remain on the display substrate 1 side and the other magenta particles M (the magenta particles M that should be detached from the display substrate 1) to move to the rear substrate 2 side at a certain pulse width, the particle amount of the magenta particles M that should be detached in accordance with the gradation migrates to the rear substrate 2 side to attach to the rear substrate 2 side and also the cyan particles C migrate to the display substrate 1 side to attach to the display substrate 1.

Figure 4C:
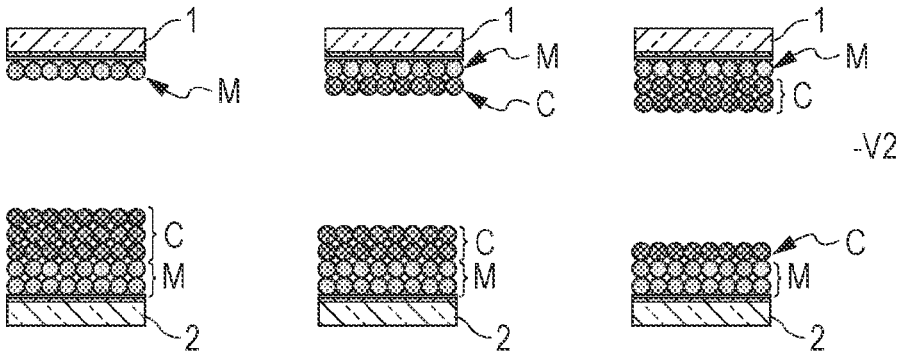
Figure 5A:
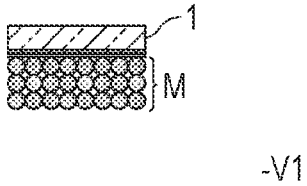
FIGS. 5A to 5C are schematic diagrams illustrating behaviors of the migrating particles in accordance with voltage applications.
Figure 5B:
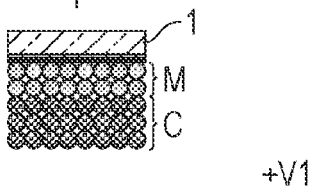
Figure 5C:
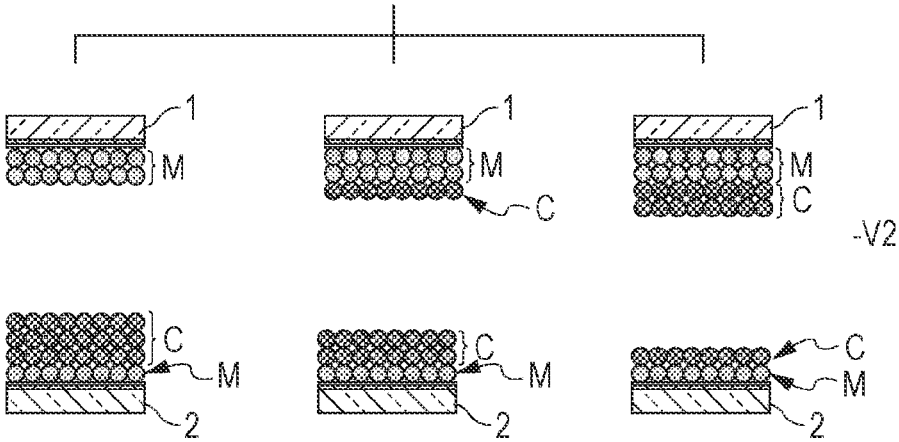

Then, as illustrated in FIG. 4C from the state of FIG. 4B, when the rear-side electrode 4 is applied with a voltage of a voltage value −V2 that is a voltage value lower than −Vc and higher than −Vm and is necessary for the particle amount of the cyan particles C among the cyan particles C on the display substrate 1 side, in accordance with the gradation that should be displayed, to remain on the display substrate 1 side and the other cyan particles C (the cyan particles C that should be detached from the display substrate 1) to attach to the rear substrate 2 side at a certain pulse width, the particle amount of the cyan particles C that should be detached in accordance with the gradation migrate to the rear substrate 2 side to attach to the rear substrate 2 side.

FIG. 4C illustrates a case in which the amount of the cyan particles C moving to the rear substrate 2 side becomes decreased in the order of the left side state, the center state, and the right side state similarly to FIG. 3C. That is, the voltage value of the applied voltage becomes low in the order illustrated at the left, at the center, and at the right of FIG. 4C.

Figure 6A:
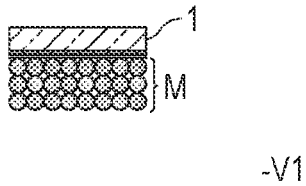
FIGS. 6A to 6C are schematic diagrams illustrating behaviors of the migrating particles in accordance with voltage applications.
Figure 6B:
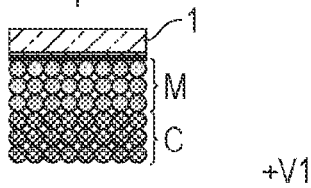
Figure 6C:
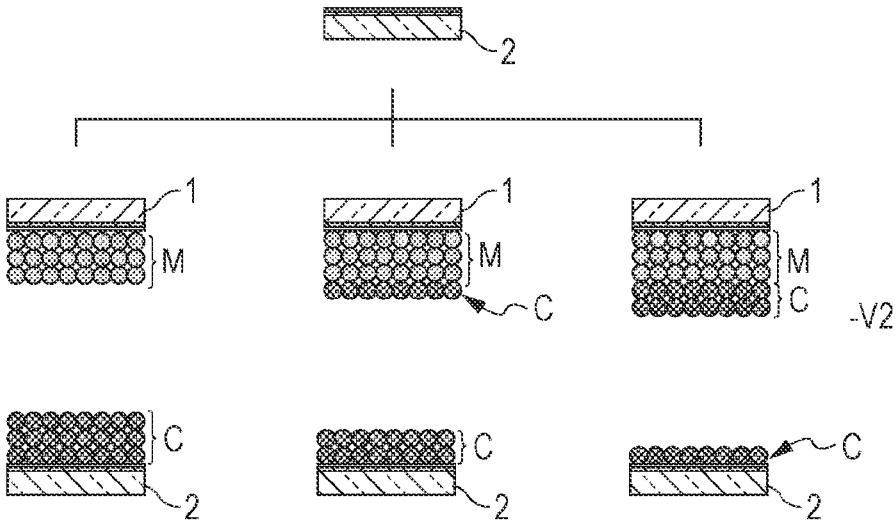

FIGS. 5A to 5C and FIGS. 6A to 6C are similar to FIGS. 4A to 4C. The particle amount of the magenta particles M moving to the rear substrate 2 side in the state of FIG. 5B from FIG. 5A and upon the shift from FIG. 6A to FIG. 6B is different from that illustrated in FIGS. 4A to 4C.

Figure 7A:
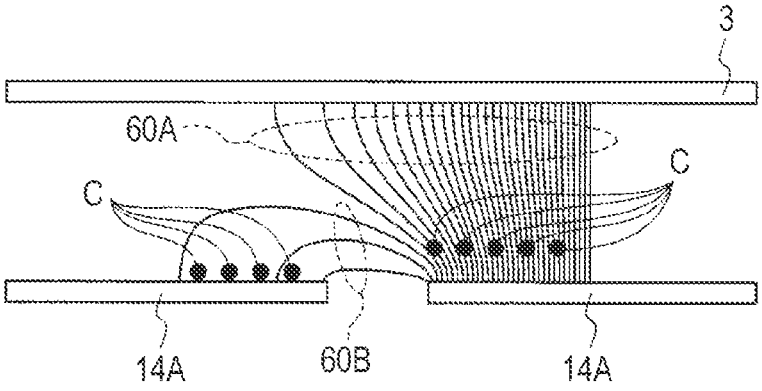
FIG. 7A and FIG. 7B illustrate lines of electric force in electric fields formed between substrates.
Figure 7B:
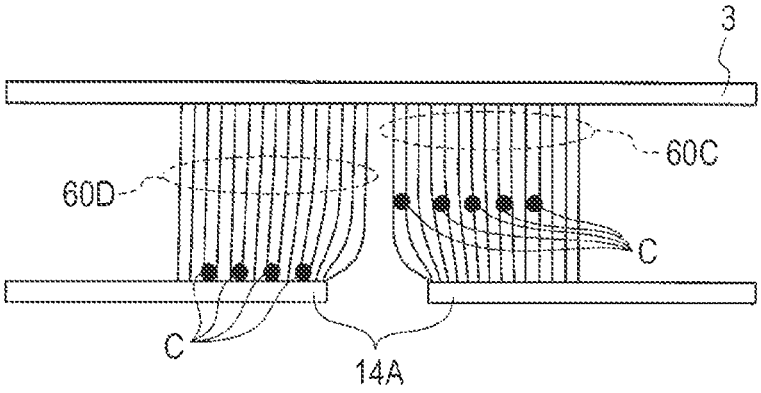

The display medium 10 is driven through an active matrix drive system as an example. For this reason, according to the present exemplary embodiment, as illustrated in FIG. 7A as an example, the display-side electrode 3 is a common electrode formed on the entire surface of the display substrate 1, and the rear-side electrodes 4 are plural isolated electrodes 14A corresponding to the number of pixels. FIG. 7A and FIG. 7B illustrate the configuration including the two isolated electrodes 14A for simplifying the description, but a large number of isolated electrodes 14A are arranged in a two-dimensional manner in actuality.

According to the present exemplary embodiment, the display-side electrode 3 that is a common electrode is grounded (0 V), and in accordance with an image that is desired to be displayed, a voltage is applied to the isolated electrodes 14A corresponding to the pixel where the particles should be moved, so that the image is displayed. That is, in a case where it is desired that the positively charged cyan particles C on the rear substrate 2 side are moved to the display substrate 1 side, a voltage in accordance with the gradation higher than or equal to +Vc is applied to the isolated electrodes 14A corresponding to the pixel where the cyan particles C should be moved.

Herein, in a state in which all the cyan particles C are arranged on the rear substrate 2 side, in a case where the isolated electrode 14A on the right side of FIG. 7A (hereinafter, referred to as isolated electrode 14AR) is an isolated electrode corresponding to the pixel where the cyan particles C should be moved to the display substrate 1 side, and the isolated electrode 14A on the left side of FIG. 7A (hereinafter, referred to as isolated electrode 14AL) is an isolated electrode corresponding to the pixel where the cyan particles C are not moved to the display substrate 1 side, according to a drive method in related art, a voltage V1 in accordance with the gradation higher than or equal to +Vc is applied to the isolated electrode 14AR, and the isolated electrode 14AL is grounded (0 V).

In this case, as illustrated in FIG. 7A, between the electrodes, not only lines of electric force 60A heading from the isolated electrode 14AR toward the display-side electrode 3 but also lines of electric force 60B heading from the isolated electrode 14AR toward the isolated electrode 14AL are formed. For this reason, a case may occur in which a part of the cyan particles C that should originally move from the isolated electrode 14AR side to the display-side electrode 3 side moves to the isolated electrode 14AL adjacent to the isolated electrode 14AR and a display density of the cyan particles C is decreased. Also, a case may occur in which the lines of electric force 60A head to the side of the isolated electrode 14AL corresponding to the pixel where an image is not desired to be displayed originally and a display resolution is decreased. In this case, the pixel of the isolated electrode 14AR may be enlarged.

In view of the above, according to the present exemplary embodiment, for example, in a case where cyan is displayed, after the first voltage V1 in accordance with the gradation higher than or equal to the threshold voltage +Vc necessary for the cyan particles C to be detached from the rear substrate 2 is applied to the isolated electrode 14AR, a second voltage V2 that has the same polarity as the first voltage V1 and is lower than the threshold voltage +Vc is applied to the isolated electrode 14AR corresponding to the pixel where the particle group is moved and the isolated electrode 14AL that is an adjacent electrode corresponding to the pixel where the particle group does not need to be moved that is adjacent to the isolated electrode 14AR.

In this manner, by applying the second voltage V2 after the first voltage V1 is applied, as illustrated in FIG. 7B, lines of electric force heading from the isolated electrode 14AR toward the isolated electrode 14AL are not formed, and lines of electric force 60C heading from the isolated electrode 14AR toward the display-side electrode 3 are formed and lines of electric force 60D heading from the isolated electrode 14AL toward the display-side electrode 3 are formed. Accordingly, the cyan particles C are not moved from the isolated electrode 14AR to the isolated electrode 14AL.

In a case where the magenta particles M are moved to the display substrate 1 side from the state of being arranged on the rear substrate 2 side, the first voltage is a voltage −V1 that is lower than −Vm which is the threshold voltage of the magenta particles M, and the second voltage is a voltage −V2 that is higher than −Vm which is the threshold voltage of the magenta particles M. That is, an absolute value of the voltage −V2 is smaller than that of the threshold voltage −Vm.

Figure 8:
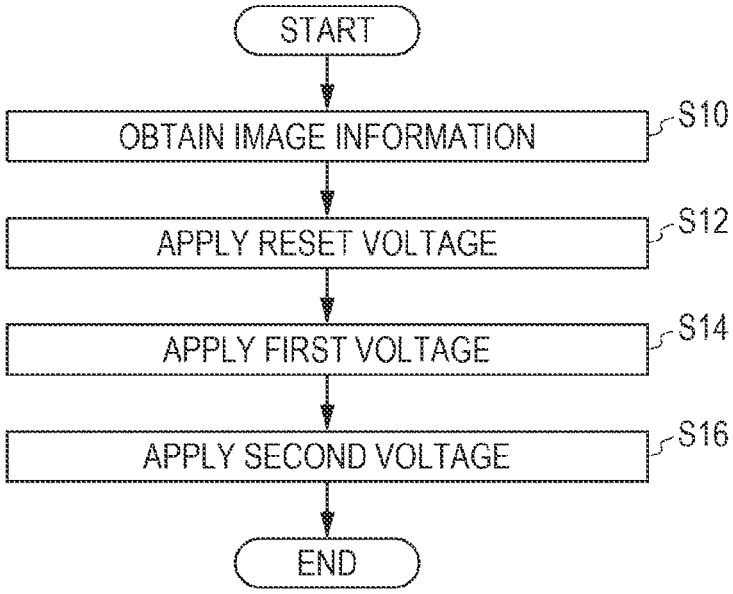
FIG. 8 is a flowchart of a process executed by a controller.

Next, as an action according to the present exemplary embodiment, a control executed by the CPU 40A of the controller 40 will be described with reference to a flowchart illustrated in FIG. 8.

First, in step S10, image information of an image that should be displayed on the display medium 10 is obtained, for example, from an external apparatus (not illustrated) via the I/O 40E.

Figure 9:
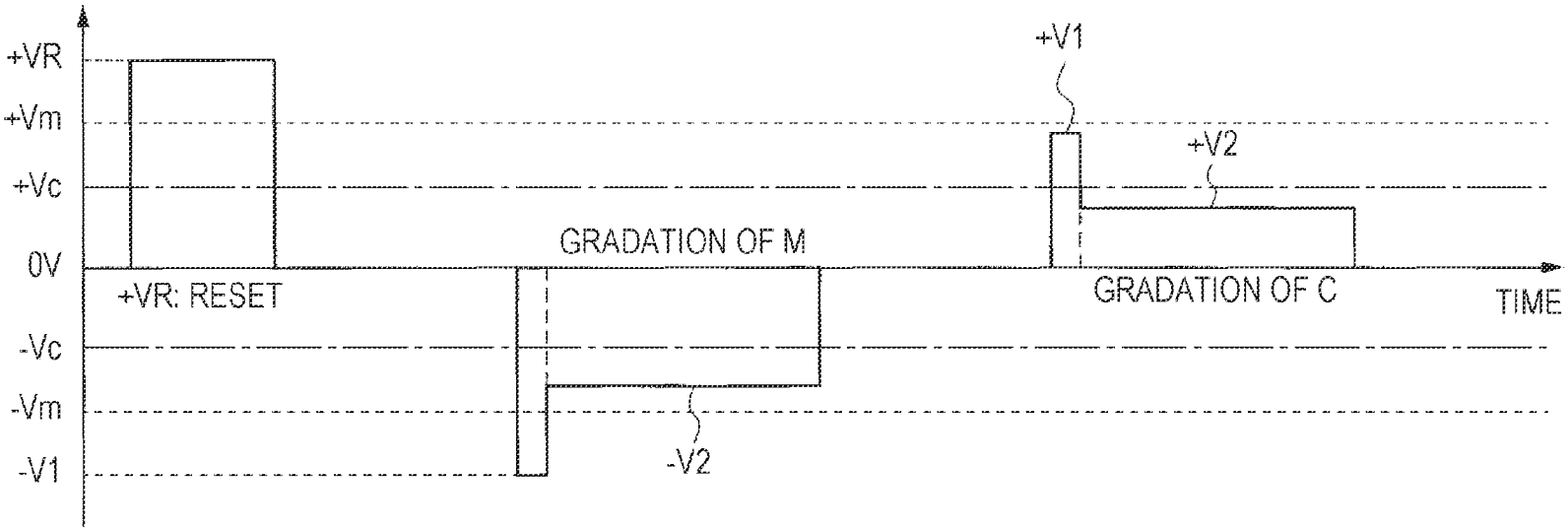
FIG. 9 is a diagram describing a voltage application sequence when the voltage is applied.

In step S12, the voltage application unit 30 is instructed to apply a reset voltage VR. Herein, the reset voltage VR is set as a voltage for all the cyan particles C to move to the display substrate 1 side and all the magenta particles M to move to the rear substrate 2 side. That is, as illustrated in FIG. 9, the reset voltage VR is a voltage higher than the threshold voltage +Vm of the magenta particles M. Accordingly, when the reset voltage VR is applied to the rear-side electrode 4, all the cyan particles C move and attach to the display substrate 1 side, and all the magenta particles M move and attach to the rear substrate 2 side.

In step S14, on the basis of the obtained image information, the CPU 40A determines a first voltage that should be applied to the rear-side electrode 4, and instructs the voltage application unit 30. The voltage application unit 30 applies the first voltage instructed from the controller 40 to the rear-side electrode 4.

This first voltage is a voltage in accordance with the gradation of the color that should be displayed on the display medium 10. For example, in a case where the gradation display of magenta is carried out, for example, as illustrated in FIG. 9, the first voltage is the voltage −V1 that is lower than −Vm which is the threshold voltage of the magenta particles M, and a voltage value thereof is determined in accordance with the gradation (density) of magenta color that should be displayed. The voltage value may be the same and the gradation may be controlled by pulse width modulation.

Among the rear-side electrodes 4, the voltage −V1 is applied to the isolated electrode corresponding to the pixel where the particles are moved and the isolated electrode corresponding to the pixel where the particles are not moved is grounded. The magenta particles M of the particle amount in accordance with the applied voltage starts to move from the rear substrate 2 to the display substrate 1 side in accordance with an image pattern and the cyan particles C at the corresponding pixel on the display substrate 1 side start to move to the rear substrate 2 side.

In step S16, among the rear-side electrodes 4, the voltage application unit 30 is instructed to apply the second voltage to the isolated electrode corresponding to the pixel where the particles are moved to the display substrate 1 side and the isolated electrode corresponding to the adjacent pixel where the particles are not moved to the display substrate 1 side that is adjacent to the pixel where the particles are moved. The voltage application unit 30 applies the second voltage, which the voltage application unit 30 is instructed from the controller 40, to the rear-side electrode 4.

This second voltage is a voltage having the same polarity as the first voltage and having an absolute value of the voltage value lower than that of the first voltage. For example, in a case where the gradation display of magenta is carried out, for example, as illustrated in FIG. 9, the second voltage is the voltage −V2 higher (an absolute value thereof is lower) than −Vm which is the threshold voltage of the magenta particles M. As a field intensity becomes higher, an attachment time is shortened, and therefore in a case where a responsivity is taken into account, the second voltage is set as a voltage as close as possible to −Vm which is the threshold voltage of the magenta particles M. Furthermore, by setting the voltage value lower than −Vc, all the cyan particles C that have not started to move in step S14 move to the rear-side electrode 4. That is, the cyan particles C move to the rear-side electrode 4 as independent from the gradation display of the magenta particles M for carrying out a reset.

After the voltage −V1 is applied to the isolated electrode corresponding to the pixel where the particles are moved to the display substrate side among the rear-side electrodes 4, the voltage −V2 is applied to the isolated electrode corresponding to the pixel where the particles are moved to the display substrate side and the isolated electrode corresponding to the adjacent pixel where the particles are not moved to the display substrate side that is adjacent to the pixel where the particles are moved, among the rear-side electrodes 4. Accordingly, as illustrated in FIG. 7B, lines of electric force heading from the isolated electrode corresponding to the pixel where the particles are moved to the display substrate 1 side toward the isolated electrode corresponding to the adjacent pixel where the particles are not moved to the display substrate side that is adjacent to the above-mentioned pixel are not formed among the rear-side electrodes 4. For this reason, the magenta particles M that should be moved to the display substrate 1 side do not move toward the adjacent pixel and move to the display substrate 1 side.

In a case where the gradation control on the cyan particles C is carried out from this state, as illustrated in FIG. 9, a voltage +V1 in accordance with the gradation that is the voltage higher than the threshold voltage +Vc of the cyan particles C and lower than the threshold voltage +Vm of the magenta particles M is applied to the rear-side electrode 4 as the first voltage. After that, a voltage V2 lower than the threshold voltage +Vc is applied to the rear-side electrode 4 as the second voltage. According to this configuration, the cyan particles C on the rear substrate 2 side are not moved in a direction of the adjacent pixel, and the cyan particles C of the particle amount in accordance with the applied voltage is moved from the rear substrate 2 and attached to the display substrate 1 side.

Figure 10:
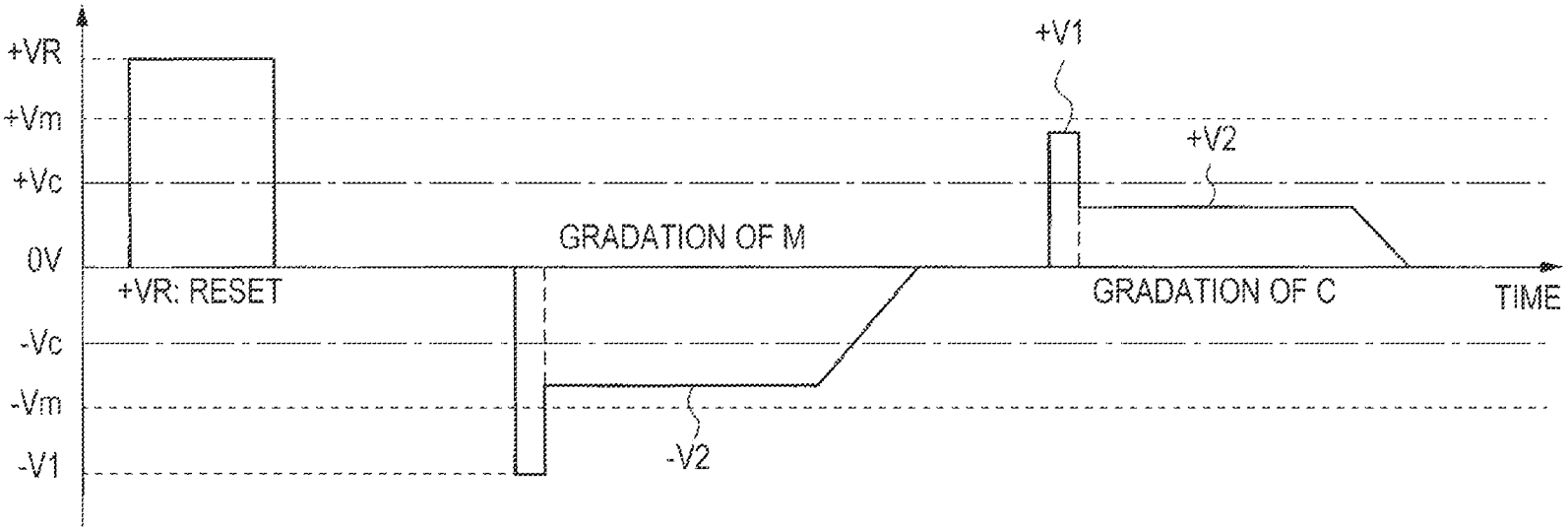
FIG. 10 is a diagram describing a voltage application sequence when the voltage is applied.

As illustrated in FIG. 10, instead of stopping the application of the voltage immediately after the second voltage is applied for a certain period of time as illustrated in FIG. 9, a control may be carried out in a manner that the second voltage is applied for the certain period of time and thereafter the voltage is gradually decreased.

Also, as a size of the pixel is decreased, that is, as sizes of the respective isolated electrodes of the rear-side electrodes 4 are decreased, a region of the pixels where the second voltage is applied, that is, a region including the isolated electrodes where the second voltage is applied may be expanded.

The display apparatus according to the present exemplary embodiment has been described above, but exemplary embodiments of the present invention are not limited to the above-mentioned exemplary embodiment.

For example, according to the present exemplary embodiment, the case has been described in which the active matrix drive is carried out in the configuration where the display substrate 1 is provided with the display-side electrode 3 that is the common electrode and the rear substrate 2 is provided with the rear-side electrode 4 composed of the plural isolated electrodes, but a configuration may also be adopted in which the display substrate 1 is provided with the display-side electrode 3 composed of plural isolated electrodes and the rear substrate 2 is provided with the rear-side electrode 4 that is a common electrode.

Also, a configuration for carrying out a passive matrix drive may be adopted in which the display-side electrode 3 is configured by plural first line electrodes and the rear-side electrode 4 is configured by plural second line electrodes orthogonal to the first line electrodes.

Also, according to the present exemplary embodiment, the case has been described in which the coloring particles of the two colors of cyan and magenta are used, but the colors are not limited to these colors. Furthermore, not only two colors but also coloring particles of three or more colors may be used, or coloring particles of one color may be used.

Also, the particle group that does not migrate is not limited to the white color particle group, and for example, a black color particle group may be used.

The movement of the particles in the direction parallel to the electrode arrangement direction, that is, movement to the adjacent pixel side is avoided also by installing the spacing members 5 illustrated in FIG. 1A at all locations between the respective pixels (in the case of FIGS. 7A and 7B, between the isolated electrode 14AL and the isolated electrode 14AR on the left and right, for example). The formation of the cell for each pixel, however, increases manufacturing costs. Also, if the size of the cell is reduced to increase the resolution, it becomes difficult to fill the respective cells uniformly with the disperse medium 6 and the migrating particle group, which increases the manufacturing costs. For this reason, the spacing members 5 are provided partially instead of being provided at all the locations between the pixels.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drive apparatus that drives a display medium that includes a display substrate having a light transparency, a rear substrate facing the display substrate with a gap between the display substrate and the rear substrate, a disperse medium filled in between the display substrate and the rear substrate, and a particle group that includes a plurality of particles which is dispersed in the disperse medium and has a color different from a color of the disperse medium and moves the plurality of particles between the substrates in accordance with an electric field, the drive apparatus comprising:

a voltage application unit that applies a first voltage and a second voltage to the display medium, wherein, in a case where the color of the particle group is displayed, the voltage application unit applies the first voltage higher than or equal to a threshold voltage necessary for the particle group to be detached from the display substrate or the rear substrate to a pixel where the particle group is moved between the substrates and thereafter applies the second voltage that has a same polarity as the first voltage and is lower than the threshold voltage to the pixel where the particle group is moved between the substrates and to a pixel which is adjacent to the pixel where the particle group is moved between the substrates and the particle group of which is not moved.

2. The drive apparatus that drives the display medium according to claim 1, wherein the voltage application unit applies the second voltage for a certain period of time and gradually decreases the second voltage.

3. The drive apparatus that drives the display medium according to claim 1, wherein the voltage application unit expands a region including the pixels where the second voltage is applied as a size of the pixel is reduced.

4. The drive apparatus that drives the display medium according to claim 2, wherein the voltage application unit expands a region including the pixels where the second voltage is applied as a size of the pixel is reduced.

5. The drive apparatus that drives the display medium according to claim 1, wherein the particle group includes a plurality of particle groups each different in colors and charge polarities.

6. The drive apparatus that drives the display medium according to claim 2, wherein the particle group includes a plurality of particle groups each different in colors and charge polarities.

7. The drive apparatus that drives the display medium according to claim 3, wherein the particle group includes a plurality of particle groups each different in colors and charge polarities.

8. The drive apparatus that drives the display medium according to claim 4, wherein the particle group includes a plurality of particle groups each different in colors, and at least two of the plurality of particle groups have different charge polarities.

9. A non-transitory computer readable medium storing a program causing a computer to execute a process for driving a display medium that includes a display substrate having a light transparency, a rear substrate facing the display substrate with a gap between the display substrate and the rear substrate, a disperse medium filled in between the display substrate and the rear substrate, and a particle group that includes a plurality of particles which is dispersed in the disperse medium and has a color different from a color of the disperse medium and moves the plurality of particles between the substrates in accordance with an electric field, the process comprising:

applying, in a case where the color of the particle group is displayed, a first voltage higher than or equal to a threshold voltage necessary for the particle group to be detached from the display substrate or the rear substrate to a pixel where the particle group is moved between the substrates; and applying a second voltage that has a same polarity as the first voltage and is lower than the threshold voltage to the pixel where the particle group is moved between the substrates and to a pixel which is adjacent to the pixel where the particle group is moved between the substrates and the particle group of which is not moved.

10. A display apparatus comprising:

a display medium that includes a display substrate having a light transparency, a rear substrate facing the display substrate with a gap between the display substrate and the rear substrate, a disperse medium filled in between the display substrate and the rear substrate, and a particle group that includes a plurality of particles which is dispersed in the disperse medium and has a color different from a color of the disperse medium; and the drive apparatus that drives the display medium according to claim 1.

11. A drive method for a display medium that includes a display substrate having a light transparency, a rear substrate facing the display substrate with a gap between the display substrate and the rear substrate, a disperse medium filled in between the display substrate and the rear substrate, and a particle group that includes a plurality of particles which is dispersed in the disperse medium and has a color different from a color of the disperse medium and moves the plurality of particles between the substrates in accordance with an electric field, the drive method comprising:

applying, in a case where the color of the particle group is displayed, a first voltage higher than or equal to a threshold voltage necessary for the particle group to be detached from the display substrate or the rear substrate to a pixel where the particle group is moved between the substrates; and applying a second voltage that has a same polarity as the first voltage and is lower than the threshold voltage to the pixel where the particle group is moved between the substrates and to a pixel which is adjacent to the pixel where the particle group is moved between the substrates and the particle group of which is not moved.

* * * * *